United States Patent [19]

Nelson

[11] Patent Number: 4,979,554

[45] Date of Patent: Dec. 25, 1990

[54] FLEXIBLE DISPLAY PANEL

[75] Inventor: LeRoy O. Nelson, Minnetonka, Minn.

[73] Assignee: Media/Graphics, Inc., Minneapolis, Minn.

[21] Appl. No.: 329,402

[22] Filed: Mar. 27, 1989

[51] Int. Cl.[5] ..... A47G 5/00

[52] U.S. Cl. ..... 160/135; 160/351; 52/239; 52/DIG. 13; 24/306; 24/589; 403/293

[58] Field of Search ..... 160/352, 135, 237, 351; 52/239, 176 DS, DIG. 13; 40/650; 24/306, 589, 442; 403/286, 292, 293

[56] References Cited

U.S. PATENT DOCUMENTS

| | | | |
|---|---|---|---|
| 1,965,644 | 7/1934 | Heffelfinger | 24/589 X |
| 2,470,921 | 5/1949 | Dow | 160/352 |
| 2,624,406 | 1/1953 | Szychoski et al. | 160/370.2 |
| 2,823,746 | 2/1958 | Morgan | 160/370.2 |
| 3,063,497 | 11/1962 | Bruecker | 160/352 |
| 4,865,111 | 9/1989 | Perutz | 160/352 X |

FOREIGN PATENT DOCUMENTS

| | | | |
|---|---|---|---|
| 558888 | 2/1975 | Switzerland | 52/DIG. 13 |

*Primary Examiner*—Blair M. Johnson
*Attorney, Agent, or Firm*—Burd, Bartz & Gutenkauf

[57] ABSTRACT

A flat flexible display panel capable of being formed into an arcuate surface display member for use as part of an exhibit booth and similar structures is disclosed. The panel is flat for convenience in carrying and storage but is capable of being formed quickly and easily into a curved display member for use in conjunction with other flat and curved surface display members. Hinged latching elements are disclosed which lie flat for shipment and storage but swing outwardly to connect together and form a flat panel into a curved surface.

14 Claims, 4 Drawing Sheets

FLEXIBLE DISPLAY PANEL

BACKGROUND OF THE INVENTION

1. Field of the Invention

This invention relates to flat flexible display panels which are easy to transport and store and which are capable of being formed simply and easily into three dimensional arcuate surface display members. Temporary displays are in widespread use at conventions, trade shows, and similar exhibitions. Such displays must be easy to carry and to store as compactly as possible. They must be easy to set up and to take down for reuse at another exhibition site. Most such temporary displays are made of flat planar panels. The present invention is directed specifically to flexible display panels which are flat for carrying and for storage but which may be readily formed into curved surface display members for use alone or in combination with planar panels.

2. Summary of the Invention

Broadly stated, the invention is directed to a flat flexible display panel capable of being formed into an arcuate surface display member and comprising a panel of stiff semi-rigid sheet material. A pair of rigid parallel spaced apart vertically extending structural members are secured to the semi-rigid panel adjacent its opposite edges. Connecting means are flexibly connected to those vertically extending structural members so as to lie flat. The connecting means are linear and have a length less than the distance between the structural members on the panel. The connecting members when folded out and connected together, thus connect the structural members together and cause the semi-rigid sheet material to be formed into a curved surface. Means are provided for connecting the resulting arcuate display member to flat panels or to other curved display members. The display members may be assembled into free standing floor displays or shorter assemblies may be used for table top displays. Shorter height display members may be vertically stacked to produce taller exhibits. Display panels of different colors may be vertically stacked or otherwise mixed for pleasing visual effects.

BRIEF DESCRIPTION OF THE DRAWINGS

The invention is illustrated in the accompanying drawings in which corresponding parts are identified by the same numerals and in which.

DETAILED DESCRIPTION OF THE PREFERRED EMBODIMENT

Figure 1:
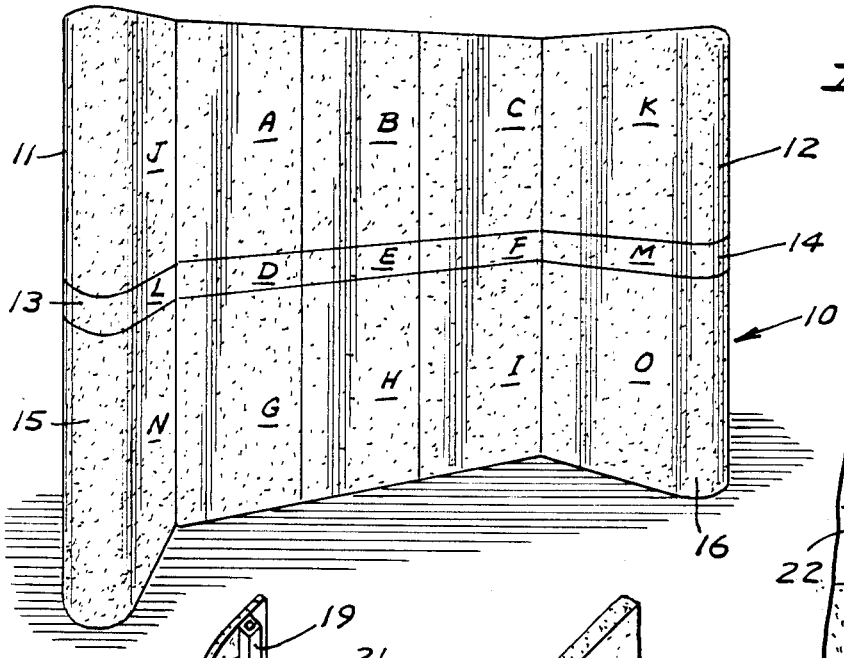
FIG. 1 is a perspective view of one form of typical free standing floor display assembly incorporating flexible display panels according to the present invention.
Figure 2:
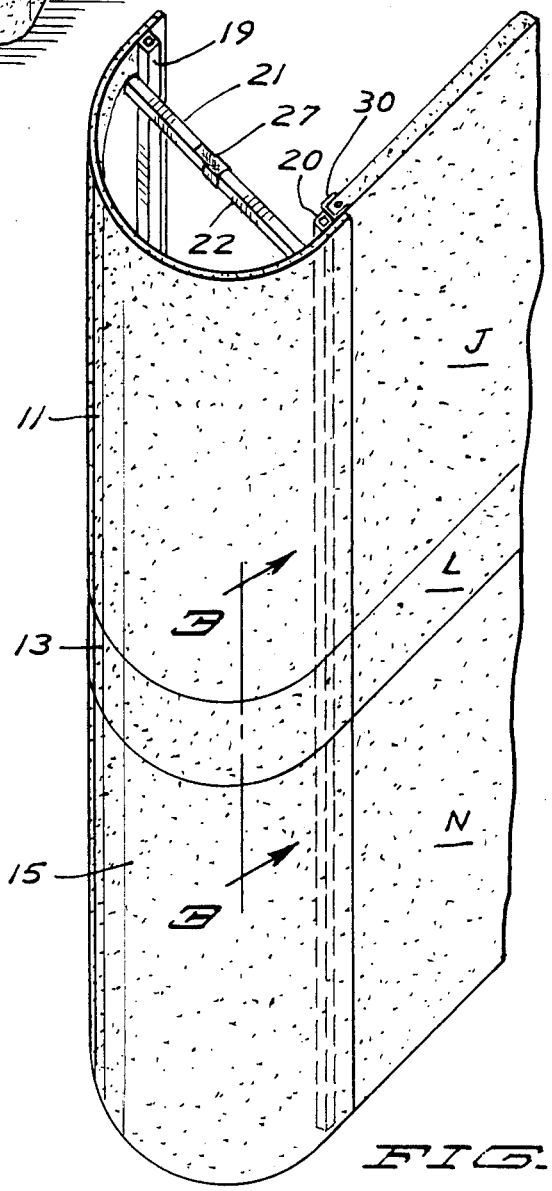
FIG. 2 is a perspective view on an enlarged scale showing flexible panels according to the present invention formed into a curved display member and joined to flat display panels.

Referring now to the drawings, FIG. 1 shows one exemplary form of a typical free standing floor display indicated generally at 10. Display 10 includes a back wall composed of nine separate flat panels A–I joined together in a single flat planar wall. Panels A–C and G–I may be of one color and narrower panels D–F may be of a different contrasting or complementary color, all of the panels being separable and assembled in vertically stacked relation. Two similar flat wings composed of similar panels J–N and K–O extend angularly outwardly from the back display wall. Vertically stacked curved display members 11–16 are connected to the free vertical edges of the angularly extending wings of the display 10. Each of curved display members 10 through 16 is formed from a flat sheet according to the present invention.

Figure 4:
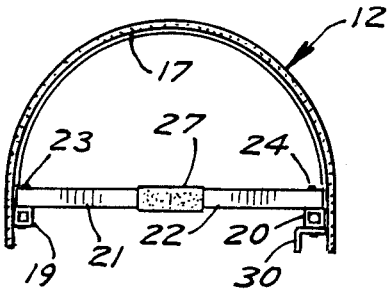
FIG. 4 is a top edge view of a single flexible panel.
Figure 5:
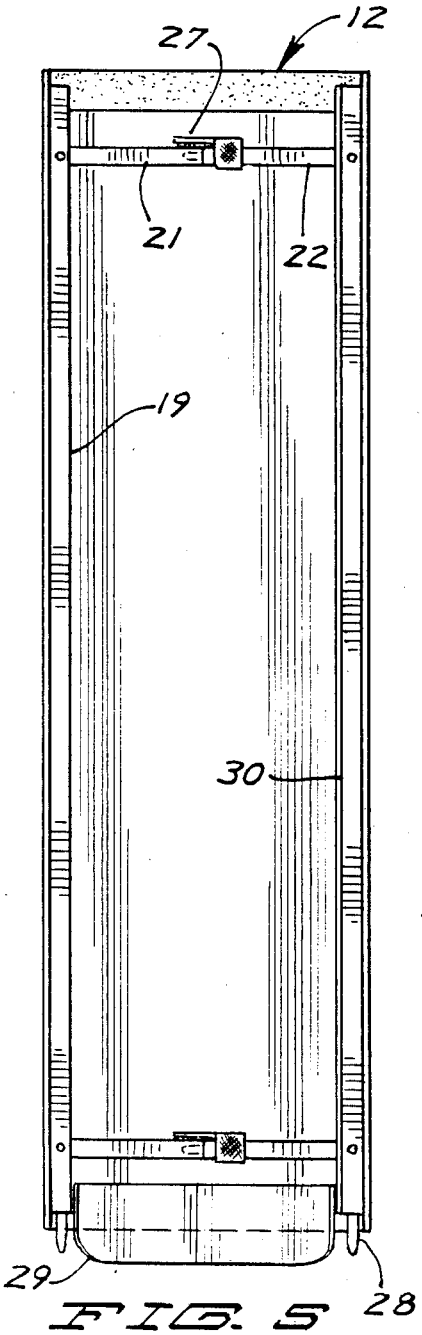
FIG. 5 is a rear elevation thereof.

As seen in FIGS. 4 and 5, the curved display members start out as a basic flat panel of stiff semi-rigid sheet material, generally synthetic resinous plastic sheet material or paperboard or cardboard of adequate strength, usually covered with cloth 18. Generally speaking, panels 17 are rectangular. However, for some special effects, a top edge or one side edge not intended to adjoin another panel may have some shape other than the edge of a rectangle.

A pair of rigid parallel spaced apart vertically extending structural members 19 and 20 are secured to the rear surface of panel 17 adjacent its opposite edges. Structural members 19 and 20 preferably extend the full height of panel 17. They preferably are tubular and of rectangular cross section and formed from lightweight material, such as extruded aluminum.

Linear connecting means in the form of latching elements 21 and 22 arc flexibly connected to structural members 19 and 20, respectively. Latching element 21 is pivotally attached at one end, at 23, to structural member 19 and latching element 22 is pivotally hinged at 24 to structural member 20. The total length of latching elements 21 and 22 is less than the distance between vertical structural members 19 and 20. Latching elements 21 and 22 are preferably tubular and rectangular in cross section and formed from the same stock as structural members 19 and 20. Latching elements 21 and 22 are hinged so as to lie flat against the rear surface of panel 17 and against the respective vertical structural members to facilitate carrying and storage of the flat panel.

Figure 6:
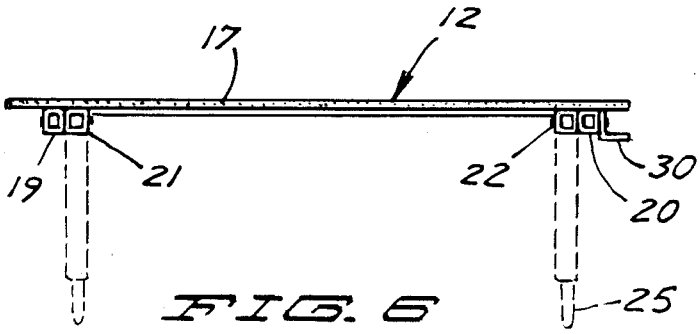
FIG. 6 is a top edge view of the same panel formed into an arcuate surface.
Figure 8:
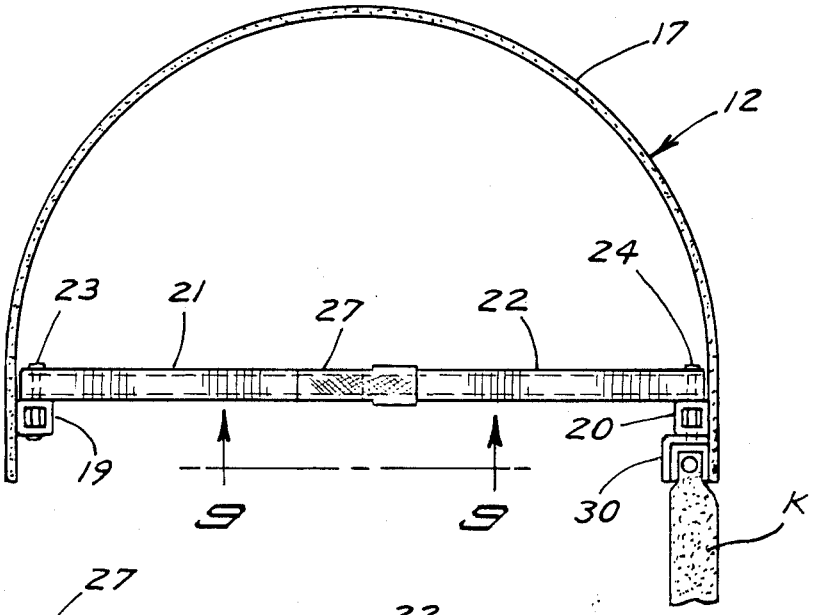
FIG. 8 is a top edge view of a flexible panel formed into a curved, display member shown on a somewhat enlarged scale and connected to a planar panel.
Figure 9:
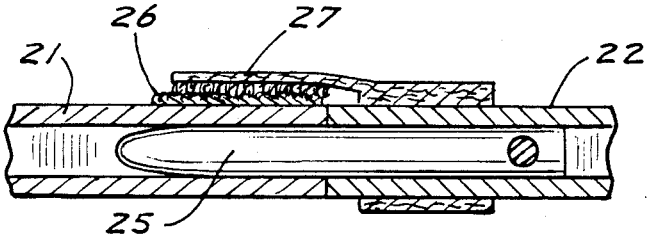
FIG. 9 is a section on a further enlarged scale on the line 9—9 of FIG. 8 and in the direction of the arrows showing details of one form of fastener for securing latching elements together.

The free end of latching element 21, opposite from hinge 23, is open. The corresponding free end of latching element 22 is fitted with a longitudinally projecting pin 25 which is engageable with a slide fit in the open end of latching element 21, as best seen in FIG. 9. Because the total length of latching elements 21 and 22 is less than the width of panel 17, in order to bring the ends of the latching elements into engagement, it is necessary to bend panel 17 into a curved configuration as shown in FIGS. 6 and 8. The shape of the curved panel member formed depends upon the relationship between the width of the panel 17 between the structural elements 19 and 20 and the combined length of the latching elements 21 and 22. In FIGS. 6 and 8, for example, latching elements 21 and 22 are equal in length to the diameter of the semi-circular configuration of the curved panel.

To insure that the ends of latching elements 21 and 22 remain in engagement, a fastener of some sort is preferably provided. This might be, for example, a hook on the end of one of the latching elements engageable with an eye on the end of the other. Preferably, however, as best seen in FIG. 9, fastening members in the form of overlapping patches 26 and 27 of interlocking filamentary fastening material, of the type sold under the trademark VELCRO, are used. One patch 26 is firmly secured to one surface of one of the latching elements. The other patch 27 is firmly secured at one end to the other of the latching elements but has an extending flap positioned to overlie and lockingly engage the first patch when the latching elements are in engagement.

Figure 3:
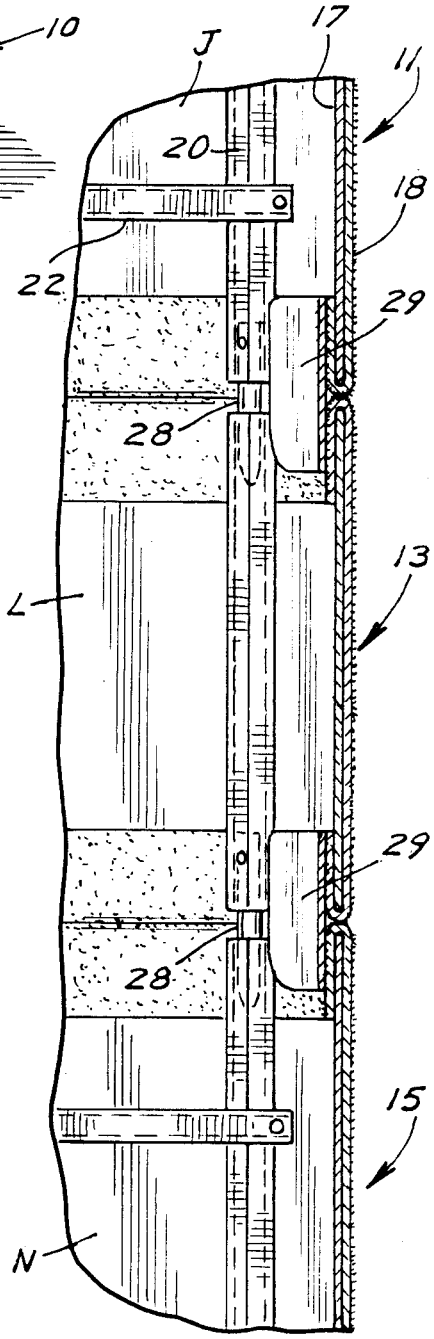
FIG. 3 is a section on a further enlarged scale along the line 3—3 of FIG. 2 and in the direction of the arrows showing details of construction of the panels.
Figure 7:
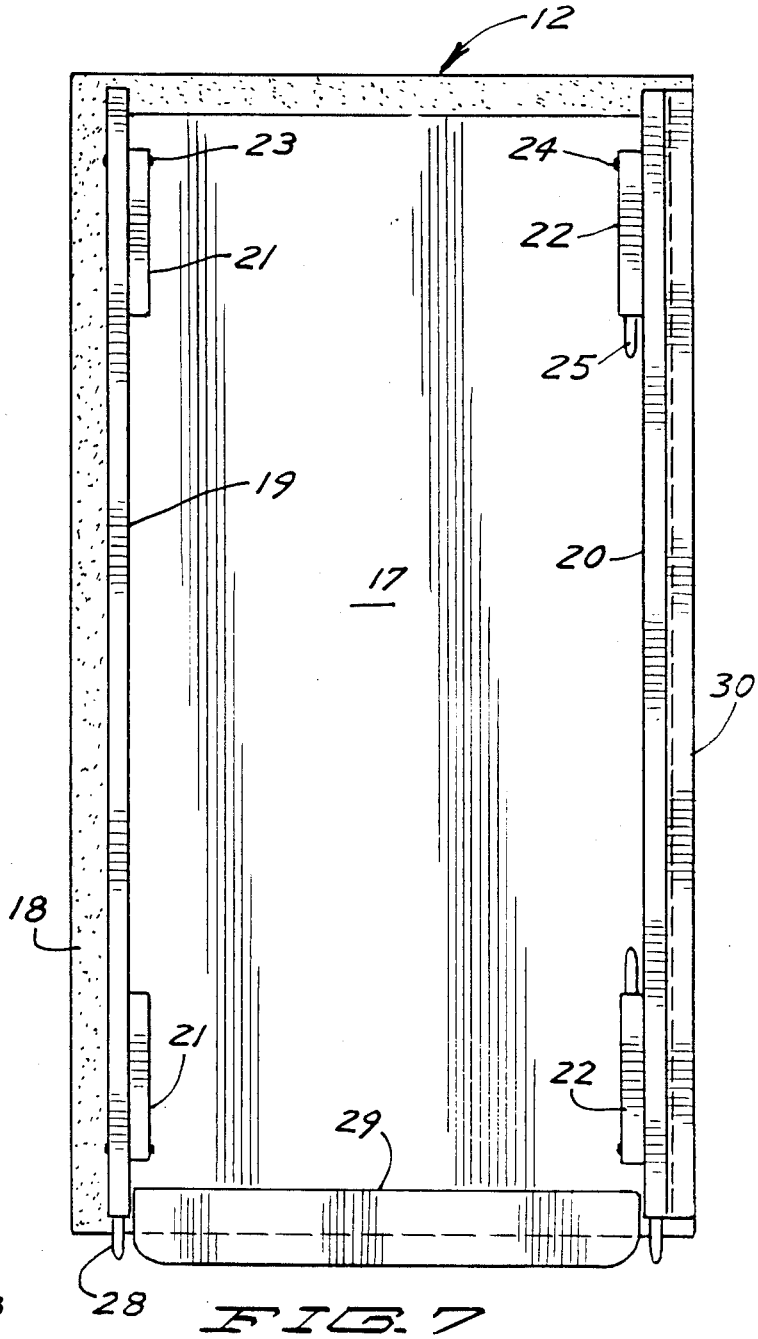
FIG. 7 is a rear elevation thereof.

When the curved surface display members are relatively tall, as in the case of members 11, 12, 15 and 16, then two or more sets of latching elements 21 and 22 are provided, as shown in FIGS. 5 and 7. Where the curved surface display member is relatively narrow, as in the case of members 13 and 14, then a single set of latching elements disposed midway between the upper and lower ends of the member is sufficient, as shown in FIG. 3.

Where the display panel members are intended to rest upon the floor or a table top, then the structural members 19 and 20 should extend to the bottommost edge of the panel sheet and are preferably provided with gliders inserted into the end of the structural members. However, where the panels are intended to be stacked vertically, one end of each tubular structural member 19 and 20 (preferably the top end) is left open and the bottom end of each is provided with a longitudinally projecting pin 28 which is engageable with a slide fit in the open end of the structural members of a next adjacent display panel member of similar construction.

To further facilitate stacking, a guide strip 29 of stiff semi-rigid sheet material is secured to the bottom inside surface of panel 17. Guide strip 29 extends below the bottommost edge of panel 17 and, as seen in FIG. 3, engages the inside surface of the next lowermost arcuate surface display member.

Figure 10:
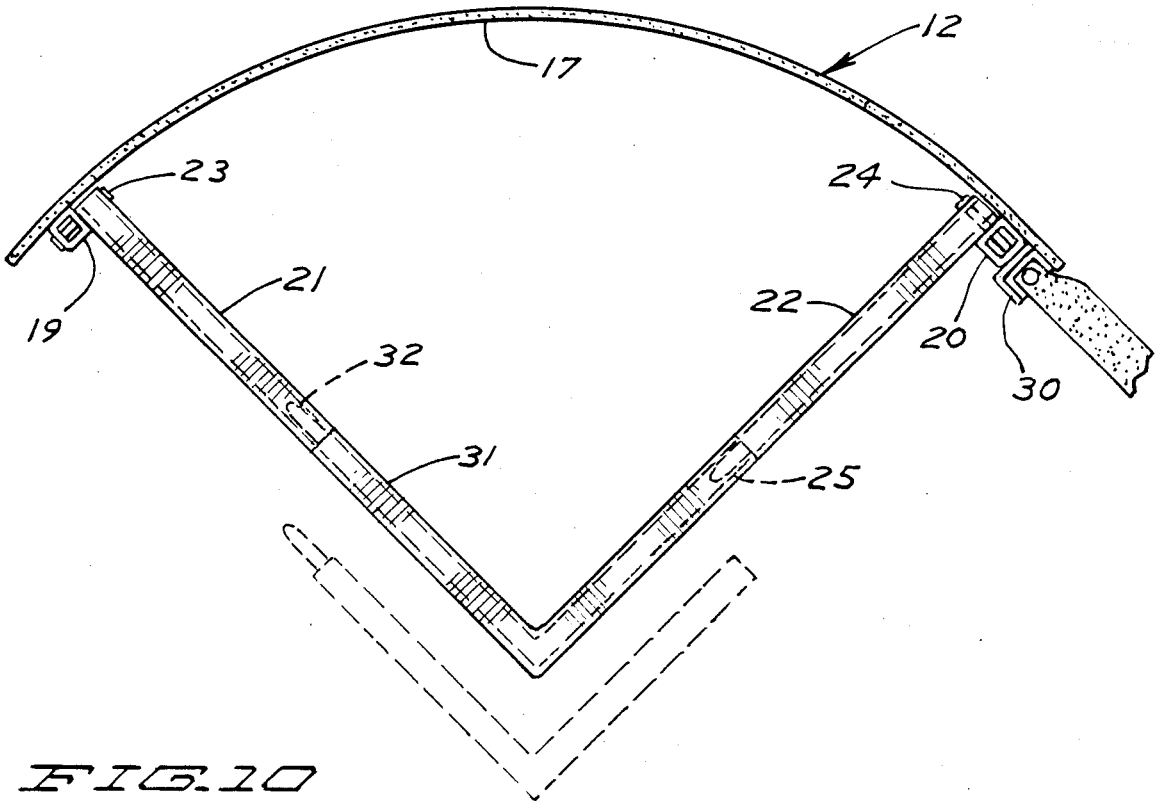
FIG. 10 is a top edge view of a modified form of curved display member.

In order to permit the curved surface display members 11, 12, etc. to be connected to adjacent flat planar display members J, K, etc., means are provided in the form of channels 30. Channels 30 are disposed vertically adjacent to but outward from vertically extending structural members 19 or 20, or both. As best seen in FIGS. 8 and 10, channels 30 engage the vertical edge of an adjoining horizontally displaced panel in edge-to-edge abutting relation.

Figure 10A:
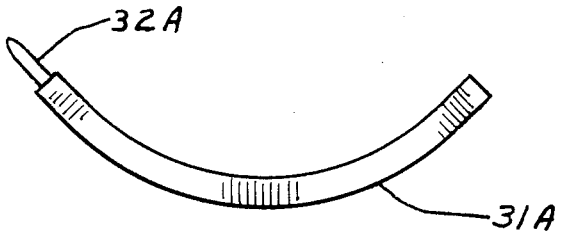
FIG. 10A is a similar fragmentary top edge view showing an alternative form of auxiliary latching element.

The cross sectional configuration of the curved surface of each display member is dependent upon the relationship between the combined length of the latching elements 21 and 22 and the width of the panel 17 between the parallel structural members 19 and 20. Wide variations are possible, depending upon particular needs. Another way in which the curvature may be varied is shown with reference to FIG. 10 where panel 17 is formed into a quarter circle by means of an auxiliary latching element 31. Auxiliary latching element 31 is formed from tubular stock, similar to latching elements 21 and 22, and formed as a right angle, the arms of which are approximately equal in length to the lengths of elements 21 and 22. One end of auxiliary latching element 31 is open and adapted to receive the projecting pin of latching element 22. The opposite end of auxiliary latching element 31 is provided with a longitudinally projecting pin 32 which is engageable with a slide fit in the open end of latching element 21. Instead of being formed as a right angle, auxiliary latching element 31 could be of similar structure but arcuate with its end faces disposed at right angles as shown in FIG. 10A at 31A with pin 32A projecting from one end. By altering the configuration of the auxiliary latching element, curved display members of varying arcuate configurations may be formed to meet particular needs. Although the arcuate surface display members are disclosed as joined to abutting flat display members, they may readily be adapted for attachment to adjoining curved members.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A flat flexible display panel capable of being formed into an arcuate surface display member and comprising:

(A) a panel of stiff semi-rigid sheet material, (B) a pair of rigid parallel spaced apart vertically extending tubular structural members secured to said panel adjacent opposite edges thereof, and (C) connecting means extendable between said structural members for forming the panel into a curvilinear surface, the distance between the ends of said connecting means being less than the distance between said structural members when the display panel is flat, said connecting means comprising:

(1) a pair of straight rigid tubular latching elements each pivotally secured at one end to one of said structural members, (2) an open end on one of said tubular elements opposite from its pivotal attachment to the structural member, and (3) a longitudinally projecting pin extending from the free end of the other of said tubular elements, said pin being engageable with a slide fit in the open end of the first tubular element, and (D) an auxiliary latching element which comprises:

(1) an angular rigid tubular element whose ends lie in angularly displaced planes, (2) a longitudinally projecting pin extending from one end of said auxiliary latching element, said pin being engageable with the open end of the first of said straight tubular elements, and (3) an open end at the opposite end of said auxiliary latching element, said open end being engageable with the projecting pin of the other of said straight tubular elements.

2. A display panel according to claim 1 wherein a patch of interlocking filamentary fastening material is firmly secured to the outer surface of each of said tubular latching elements adjacent the free ends thereof in overlapping fastening relation to one another.

3. A display panel according to claim 1 wherein means are provided adjacent at least one vertical edge of said semi-rigid panel for joining said panel in edge-to-edge abutting relation to the vertical edge of an adjoining horizontally displaced panel.

4. A display panel according to claim 3 wherein said means for joining adjacent panels comprises a vertically extending longitudinal channel engageable with the vertical edge of an adjoining horizontally displaced panel.

5. A display panel according to claim 1 wherein:

(A) said vertically extending structural members are rigid tubular members extending the full vertical length of said semi-rigid panel; and (B) one end of each of said tubular members is open and the opposite end includes a longitudinally projecting pin engageable with a slide fit in the open end of a corresponding tubular member of an adjoining vertically displaced flexible panel.

6. A display panel according to claim 5 wherein a guide strip of stiff semi-rigid sheet material is secured to the inside surface of said semi-rigid panel between said pins, said guide strip extending beyond the horizontal edge of the flexible panel and engageable with the inside surface of a like adjoining vertically displaced flexible panel.

7. A display panel according to claim 1 wherein said vertically extending tubular structural members are of square cross-section.

8. A display panel according to claim 1 wherein said rigid tubular latching elements are of square cross-section.

9. A flat flexible display panel capable of being formed into an arcuate surface display member and comprising:

(A) a panel of stiff semi-rigid sheet material, (B) a pair of rigid parallel spaced apart vertically extending tubular structural members secured to said panel adjacent opposite edges thereof, and (C) connecting means extendable between said structural members for forming the panel into a curvilinear surface, the distance between the ends of said connecting means being less than the distance between said structural members when the display panel is flat, said connecting means comprising:

(1) a pair of straight rigid tubular latching elements each pivotally secured at one end to one of said structural members, (2) an open end on one of said tubular elements opposite from its pivotal attachment to the structural member, and (3) a longitudinally projecting pin extending from the free end of the other of said tubular elements, said pin being engageable with a slide fit in the open end of the first tubular element, and (D) an auxiliary latching element which comprises:

(1) an arcuate rigid tubular element whose ends lie in angularly displaced planes, (2) a longitudinally projecting pin extending from one end of said auxiliary latching element, said pin being engageable with the open end of the first of said straight tubular elements, and (3) an open end at the opposite end of said auxiliary latching element, said open end being engageable with the projecting pin of the other of said straight tubular elements.

10. A display panel according to claim 9, wherein a patch of interlocking filamentary fastening material is firmly secured to the surface of each of said tubular latching elements adjacent the free ends thereof in overlapping fastening relation to one another.

11. A display panel according to claim 9 wherein means are provided adjacent at least one vertical edge of said semi-rigid panel for joining said panel in edge-to-edge abutting relation to the vertical edge of an adjoining horizontally displaced panel.

12. A display panel according to claim 11 wherein said means for joining adjacent panels comprises a vertically extending longitudinal channel engageable with the vertical edge of an adjoining horizontally displaced panel.

13. A display panel according to claim 9 wherein:

(A) said vertically extending structural members are rigid tubular members extending the full length of said semi-rigid panel, and (B) one end of each of said tubular members includes a longitudinally projecting pin engageable with a slide fit in the open end of a corresponding tubular member of an adjoining vertically displaced flexible panel.

14. A display panel according to claim 13 wherein a guide strip of stiff semi-rigid sheet material is secured to the inside surface of said semi-rigid panel between said pins, said guide strip extending beyond the horizontal edge of the flexible panel and engageable with the inside surface of a like adjoining vertically displaced flexible panel.

* * * * *